US006439466B2

(12) United States Patent
Fikes

(10) Patent No.: US 6,439,466 B2
(45) Date of Patent: Aug. 27, 2002

(54) CLIMATE CONTROL SYSTEM

(76) Inventor: Jody D. Fikes, 4502 Ridgecove Dr., Rowlett, TX (US) 75088

( * ) Notice: Subject to any disclaimer, the term of this patent is extended or adjusted under 35 U.S.C. 154(b) by 0 days.

(21) Appl. No.: 09/867,299

(22) Filed: May 29, 2001

Related U.S. Application Data

(63) Continuation-in-part of application No. 09/399,389, filed on Sep. 20, 1999.

(51) Int. Cl.[7] ..... F23N 23/00
(52) U.S. Cl. ..... 236/11; 236/15 R; 454/343
(58) Field of Search ..... 454/343, 344, 454/339, 236; 236/11, 15 R

(56) References Cited

U.S. PATENT DOCUMENTS

| | | | | | |
|---|---|---|---|---|---|
| 3,800,689 | A | | 4/1974 | Brown | 98/115 |
| 3,882,928 | A | | 5/1975 | Gazzo | 165/12 |
| 4,094,336 | A | | 6/1978 | Urschel et al. | 137/512.1 |
| 4,164,901 | A | | 8/1979 | Everett | 98/33 A |
| 4,184,538 | A | | 1/1980 | Rauenhorst | 165/66 |
| 4,251,026 | A | * | 2/1981 | Siegel et al. | 234/49 |
| 4,765,231 | A | * | 8/1988 | Aniello | 454/343 |
| 4,776,385 | A | | 10/1988 | Dean | 165/16 |
| 4,838,150 | A | | 6/1989 | Suzuki et al. | 98/31.5 |
| 5,139,009 | A | | 8/1992 | Walsh | 126/299 R |
| 5,415,011 | A | | 5/1995 | Gilmore et al. | 62/262 |
| 5,934,362 | A | | 8/1999 | Barker, II | 165/48 |

* cited by examiner

*Primary Examiner*—Harold Joyce
*Assistant Examiner*—Derek S. Boles
(74) *Attorney, Agent, or Firm*—Conley, Rose & Tayon, P.C.

(57) ABSTRACT

A climate control system includes an air evacuation and ventilation system thereof operable to withdraw air from an outflow air duct system and ventilate the withdrawn air to the outside prior to the system treating air withdrawn from an interior space of a building through an inflow air duct system. The air evacuation and ventilation system includes a ventilation duct having a first end in communication with an air outlet junction box and a second end having an opening located outside the building, an exhaust fan, supportably mounted within the junction box, for drawing air out of the outflow air duct system and into the ventilation duct, and a damper, supportably mounted within the junction box and pivotable between a closed position in which the damper prevents air from flowing into the ventilation duct and an open position in which air is drawn into the ventilation duct.

38 Claims, 5 Drawing Sheets

CLIMATE CONTROL SYSTEM

CROSS-REFERENCE TO RELATED APPLICATION

This application is a Continuation-in-Part ("C-I-P") of U.S. patent application Ser. No. 09/399,389 filed Sep. 20, 1999, entitled "Air Duct Evacuation System" and hereby incorporated by reference as if reproduced in its entirety.

TECHNICAL FIELD

This specification relates generally to climate control systems and, more particularly, to a climate control system capable of exhausting air ducts associated therewith prior to initiating heating, cooling, ventilating or other climate control operations

BACKGROUND

The advantages of evacuating air or otherwise ventilating the interior portions of buildings and other structures have been widely appreciated for a number of years. For example, during the summer months, the air in the attic or other above-ground uninsulated portion of a building can easily reach temperatures exceeding 130 degrees Fahrenheit. As the heated air penetrates the insulation separating the uninsulated portion of the building from an insulated portion of the building typically used as the living and/or working space thereof, the temperature in the insulated portion of the building begins to climb. The reverse occurs during winter when the colder air in the uninsulated portion of the building causes the temperature in the insulated portion of the building to drop as the colder air penetrates the insulation separating the uninsulated portion of the building from the insulated portion thereof.

For a number of years, buildings and other structures have been equipped with climate control systems designed to maintain the temperature within a portion of the building, typically, the aforementioned insulated portion used as the living and/or working space thereof, within a pre-selected temperature range, thereby preventing that portion of the building from reaching undesired temperature extremes. In various configurations thereof, such a climate control system may include a heating system which serves to warm the interior of the building during cold weather, a ventilating system for circulating air through the interior of the building, a cooling system which serves to cool the building during hot weather, and/or another type of climate control system. Typically, however, climate control systems are configured to include a heating unit such as a furnace, a cooling unit such as an air conditioner and a central unit which includes an air handler where air withdrawn from the interior of the building is treated by the selective heating or cooling thereof. As climate control systems also include one or more fans to draw air from the interior of the building into the air handler of the central unit for treatment and/or one or more blowers to force the treated air back into the interior of the building, by operating these fans and/or blowers without the use of the furnace or air conditioner to treat the air, a typical climate control system is also capable of performing certain ventilating operations.

Regardless of their particular configuration, an important component of all heating, ventilating and cooling systems, as well as any other interior climate control system which integrates one or more of the aforementioned heating, ventilation and/or cooling systems into an integrated climate control system, is the air distribution system—a network of one or more air ducts used to circulate air throughout the building. Typically, the air distribution system is comprised of inlet and outlet sides. The inlet side includes one or more air intake registers and a first duct system which extends from the air intake registers to an inlet side of a junction box, which, in turn, is coupled to the inlet side of the central unit. Air drawn into the air intake register is transferred via the first duct system and the inlet junction box to the central unit for treatment, typically, using a thermal transfer process by which the air is either heated or cooled. The treated air exits the outlet side of the central unit where it enters an outlet junction box coupled to the outlet side of the air distribution system. From the outlet junction box, the treated air is forced through a second duct system and out one or more air outlet registers.

In most buildings, the ducts which respectively form part of the inlet and outlet sides of the air distribution system are located in the attic, walls, crawl spaces and other uninsulated portions of the building. As a result, air residing within these ducts, for example, cooled or heated air which is left in the ducts after the air conditioner or furnace cycles off for an elongated period after successfully adjusting the temperature within the building to a desired temperature, may either cool or heat rapidly and then penetrate the interior living space of the building. Of even greater concern, when the air conditioner or furnace cycles back on, the cooled or heated air left in air ducts, particularly those forming part of the outlet side of the air distribution system, would be quickly pumped into the interior living space of the building. If the first air pumped into the interior living space has remained in the air ducts on the outlet side of the air distribution system for a period of time, the temperature differential between that air and the desired temperature for the interior living space could very possibly be greater than the temperature differential between the current and desired temperatures for the interior living space. Under such circumstances, since the climate control system would initiate a cycle, for example, a cooling cycle, by pumping in air hotter than the current temperature of the interior living space, the initial stage of the cooling cycle would tend to increase the total time needed to cool the interior space of the building to the desired temperature.

U.S. Pat. No. 4,765,231 to Aniello discloses an air conditioning system in which, when a potentially harmful level of smoke is detected, supply fan motors associated with the duct work are reversed in direction so as to evacuate the smoke through registers in the rooms and into the duct work. The smoke is then exhausted away from the building through an outside ventilating unit. However, while Aniello does remove air from ducts located on the outlet side of an air conditioning system, Aniello is clearly directed to an smoke exhaustion system intended for operation under emergency conditions and nowhere contemplates incorporating the disclosed exhaustion techniques into a climate control system.

In recent years, a number of new products and/or techniques which enhance the insulative characteristics of buildings have been developed. While it is widely recognized that recently constructed buildings are better insulated against temperature changes resulting from temperature differentials between the insulated interior space of the building and the outside/uninsulated interior space of the building, such improvement products and/or techniques have also caused certain adverse effects. Specifically, while modern construction is better insulated to prevent heat transfers, the lack of fresh air being introduced into such buildings has caused a variety of physical ailments in those living and/or working at such buildings and/or structures. Thus, newly constructed buildings have a greater need for suitable ventilating systems than buildings constructed in years past. While a variety of ventilating systems have been disclosed, generally such ventilating systems are designed to draw air out of the interior space of a building directly and are not fully integrated with the climate control system of the building.

Finally, in my prior U.S. patent application Ser. No. 09/399,389, I disclosed an air duct evacuation system capable of exhausting air from ducts located on the outlet side of an air handler. However, the disclosed air duct evacuation system lacked any provision for replenishing the air forcibly exhausted from the building. The absence of such an air replenishment system raises the concern that a pressure differential between the interior space of the building and the outside may develop over time, particularly in those modem buildings tightly sealed to prevent ventilation between the interior space of the building and the outside which naturally occurred in older structures. For example, if the interior space of a building was at a lower pressure relative to the outside, the potential exists for radon or other naturally occurring, but quite harmful, gases to more readily collect within the building. While it is acknowledged that the adverse effects of such a pressure differential have not been fully explored, it would clearly be preferable to prevent such pressure differentials from ever developing.

Therefore, what is needed is a climate control system uniquely configured to withdraw unsuitable air from ducts located on an outlet side thereof. It is, therefore, an object of the invention to provide such a climate control system.

SUMMARY

In one embodiment, the present invention is directed to a climate control system for treating air within an interior space of a building. The climate control system includes a central unit, a first air duct system coupled to an inlet side of the central unit, a second air duct system coupled to an outlet side of the central unit and an air evacuation system. The climate control system is configured such that, prior to the central unit thereof treating air withdrawn from the interior space of the building through the first air duct system and returning the treated air to the interior space of the building through the second air duct system, the air evacuation system operates to withdraw air from the second air duct system.

In one aspect of this embodiment of the invention, the climate control system further includes a controller coupled to the air evacuation system and the central unit. The controller first actuates the evacuation of air from the second air duct system and, subsequent to the evacuation of the second air duct system, the controller then actuates the treatment of the air withdrawn from the interior space of the building through the first air duct system. In another, the controller initiates actuation of the air evacuation system and the central unit by executing an actuation sequence. In a further aspect thereof, the actuation sequence includes first and second steps. In the first step, the controller actuates the air evacuation system for a pre-selected period of time, and, in the second step, the controller actuates the central unit until a measurable physical condition meets a pre-selected threshold value. In a still further aspect thereof, the pre-selected period of time is selected based upon the time required for the air evacuation system to evacuate air from the second air duct system and the selected period of time is allowed to expire and the air evacuation system deactuated prior to the controller actuating the central unit. In accordance with a further aspect thereof, the measurable physical condition is temperature and the controller includes a sensor for determining temperature of the interior space of the building.

In still further aspects thereof, the central unit is alternately configured to treat air within the interior space of the building by warming the air withdrawn from the interior space of the building through the first air duct system and then returning the warmed air to the interior space of the building through the second air duct system or to treat air within the interior space of the building by cooling the air withdrawn from the interior space of the building through the first air duct system and then returning the cooled air to the interior space of the building through the second air duct system. If the central unit heats the withdrawn air, the controller executes the actuation sequence upon determining that the temperature of the interior space of the building has dropped below a preselected threshold value. Conversely, if the central unit cools the withdrawn air, the controller executes the actuation sequence upon determining that the temperature of the interior space of the building has risen above a pre-selected threshold value.

In another embodiment thereof, the present invention is directed to a climate control system for treating air within an interior space of a building. The climate control system includes a central unit, a first air duct system coupled to an inlet side of the central unit, a second air duct system coupled to an outlet side of the central unit and an air evacuation system. The central unit treats air withdrawn from the interior space of the building through the first air duct system and returns the treated air to the interior space of the building through the second air duct system while the air evacuation system operates to withdraw air from the second air duct system prior to the central unit treating air withdrawn from the interior space of the building through the first air duct system and returning the treated air to the interior space of the building through the second air duct system. The air evacuation system includes a ventilation duct having a first end in communication with the second air duct system and a second end having an opening located outside the building and a exhaust fan for drawing air out of the second air duct system and into the ventilation duct. In accordance with this embodiment of the invention, the exhaust fan is operable to draw air out of the second air duct only when the central unit is not returning treated air to the interior space of the building through the second air duct system.

In one aspect thereof, the air evacuation system further includes a damper attached to the first end of the ventilation duct and pivotable between a closed position in which the damper prevents air from flowing into the ventilation duct and an open position in which the second air duct system is in communication with the ventilation duct. In another, the controller is coupled to the exhaust fan and the damper for actuating the evacuation of the second air duct system and to the central unit for actuating the treatment of the air withdrawn from the interior space of the building through the first air duct system and, in still another, the controller initiates actuation of the air evacuation system and the central unit by executing an actuation sequence comprised of a first step in which the controller issues a first control signal to the damper to cause the damper to move from the closed position to the open position and a first control signal to the exhaust fan to cause the exhaust fan to begin rotating such that air is drawn out of the second air duct system and into the ventilation duct and a second step, executed a pre-selected period of time after the first step is executed, in which the controller issues a second control signal to the damper to cause the damper to move from the open position to the closed position, a second control signal to the exhaust fan to cause the exhaust fan to stop rotating, and a first control signal to the central unit to cause the central unit to begin treating air withdrawn from the interior space of the building through the first air duct system. As before, the pre-selected period of time may be selected based upon the time required for the air evacuation system to evacuate the second air duct system. In this aspect, however, the actuation sequence may further include a third step in which the controller issues a second control signal to the central unit which causes the central unit to stop treating air withdrawn from the interior space of the building through the first air duct system when a measurable physical condition, for example, temperature, meets a pre-selected threshold value.

In still another embodiment thereof, the present invention is directed to a climate control system for treating air within an interior space of a building which includes a central unit, a first air duct system having an outlet side coupled to an inlet side of the central unit, a second air duct system having an inlet side coupled to an outlet side of the central unit, and an air evacuation and exhaustion system. The central unit treats air withdrawn from the interior space of the building through the first air duct system and returns the treated air to the interior space of the building through the second air duct system. The air evacuation and exhaustion system, on the other hand, withdraws air from the second air duct system and exhausts the withdrawn air from the building. In accordance with this embodiment of the invention, the air evacuation and exhaustion system withdraws and exhausts air from the second air duct system as a preparatory step performed in advance of the central unit treating air withdrawn from the interior space of the building and returning the treated air to the interior space of the building through the second air duct system.

In one aspect thereof, the climate control system further includes an air replenishment system for replenishing air evacuated from the second air duct system. In another, the climate control system further includes an air outlet junction box coupled between the outlet side of the central unit and the inlet side of the second air duct system. In this aspect of the invention, treated air pumped out of the central unit is returned to the interior space of the building through the air outlet junction box and the second air duct system.

In still another aspect of this embodiment of the invention, the air evacuation and exhaustion system includes a ventilation duct having a first end in communication with the air outlet junction box and a second end having an opening located outside the building, and a exhaust fan for drawing air out of the second air duct system and into the ventilation duct. In this aspect, the exhaust fan is operable to draw air out of the second air duct only when the central unit is not returning treated air to the interior space of the building through the air outlet junction box and the second air duct system.

In a still further aspect of this embodiment of the invention, the exhaust fan is supportably mounted within the air outlet junction box. In another, the air evacuation and ventilation system includes a damper pivotable between a closed position in which the damper prevents air from flowing into the ventilation duct and an open position in which air may flow through the damper and into the ventilation duct. In this aspect, the damper is also supportably mounted within the air outlet junction box.

In other aspects thereof, the air evacuation and ventilation system may include a booster fan for assisting the exhaust fan in forcing air, drawn out of the second air duct, out the opening located outside the building. In various ones of these aspects, the booster fan may be supportably mounted at the second end of the ventilation duct, within the ventilation duct, at a location intermediate the first and second ends thereof, or within the second air duct system.

In still other aspects of this embodiment of the invention, the air replenishment system may include an air replenishment duct having a first end having an opening located outside the building and a second end in communication with the central unit of the climate control system. In further aspects thereof, a flapper valve movable between a first position in which the flapper valve prevents outside air from being drawn into the air outlet junction box through the air replenishment duct and a second position in which the flapper valve allows outside air to be drawn into the air outlet junction box through the air replenishment duct may be supportably mounted within the air replenishment duct at a location intermediate the first and second ends thereof.

In still further aspects thereof, the climate control system may include a controller coupled to the exhaust fan and the damper for actuating the evacuation of the second air duct system, to the central unit for actuating the treatment of the air withdrawn from the interior space of the building through the first air duct system and to the flapper valve for actuating replenishment of the air evacuated from the second air duct system.

In certain further aspects thereof, the controller initiates actuation of the air evacuation and ventilation system, the central unit and the air replenishment system by executing an actuation sequence. In one such further aspect, the actuation sequence is comprised of a first step in which the controller issues a first control signal to the damper to cause the damper to move from the closed position to the open position and a first control signal to the exhaust fan to cause the exhaust fan to begin rotating such that air is drawn out of the second air duct system and into the ventilation duct and a second step, executed a pre-selected time period after the first step, in which the controller issues a second control signal to the damper to cause the damper to move from the open position to the closed position, a second control signal to the exhaust fan to cause the exhaust fan to stop rotating, a first control signal to the central unit to cause the central unit to begin treating air withdrawn from the interior space of the building through the first air duct system and a first control signal to the flapper valve to cause the flapper valve to move from the closed position to the open position. By executing this actuation sequence, the central unit generates a flow of treated air through the air outlet junction box which draws outside air, through the air replenishment duct, thereinto.

In another aspect, the pre-selected period of time is selected based upon the time required for the air evacuation system to remove all untreated air from the second air duct system and, in still other aspects, the actuation sequence may include third and/or fourth, steps. In the third step, the controller issues a second control signal to the flapper valve which causes the flapper valve to move from the open position to the closed position and, in the fourth step, the controller issues a second control signal to the central unit which causes the central unit to stop treating air withdrawn from the interior space of the building through the first air duct system. In the aspect of the invention in which the actuation sequence includes the fourth step, the fourth step would be executed when a measurable physical condition meets a preselected threshold value.

DETAILED DESCRIPTION

Figure 1:
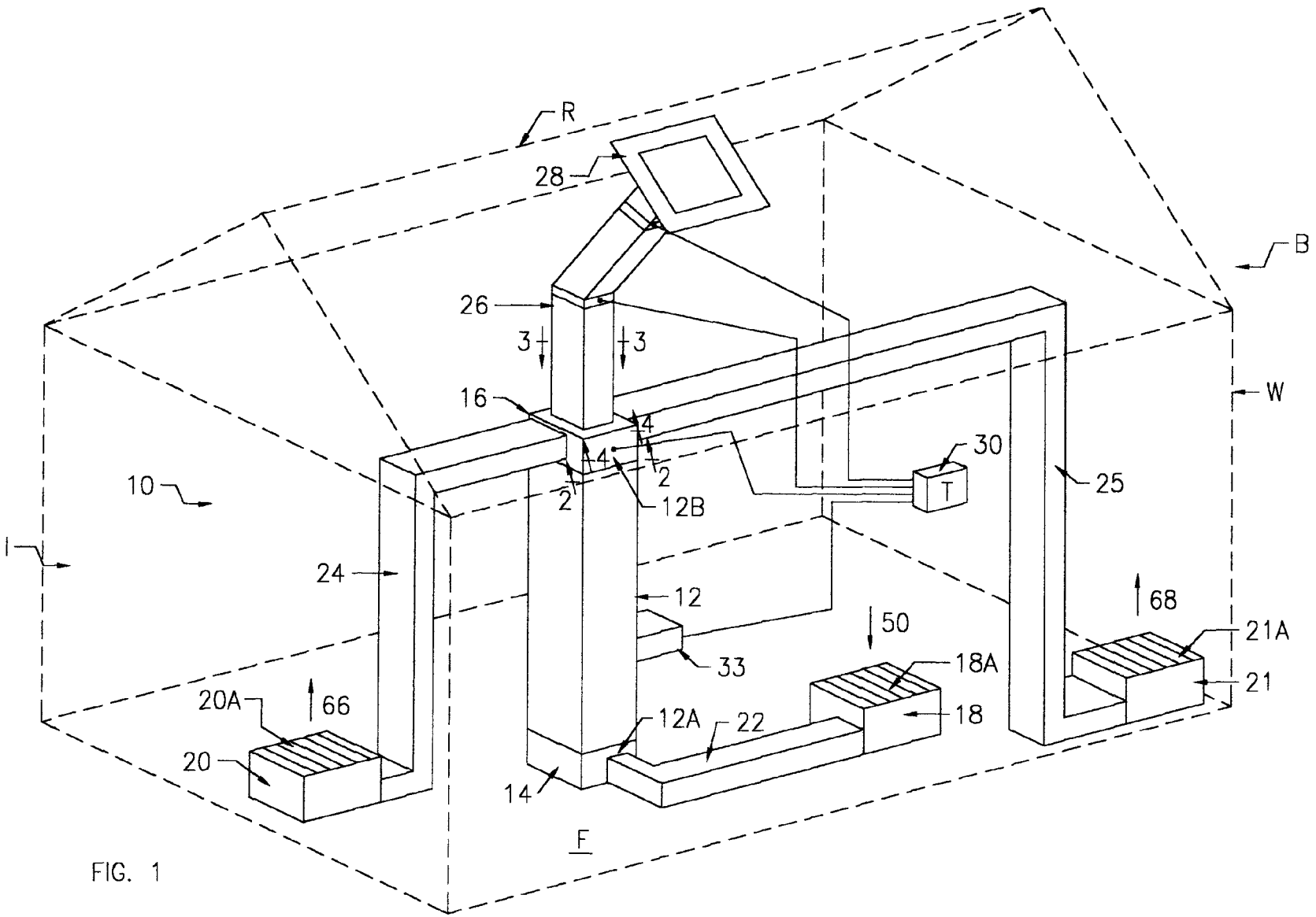
FIG. 1 is a perspective view of a building or other structure having a climate control system constructed in accordance with the teachings of the present invention incorporated therein.

Referring first to FIG. 1, a building B having an interior space I defined by wall structure W and roof R may now be seen. For ease of illustration, the building B is configured as a single story, one room structure without interior walls. It is fully contemplated, however, that the present invention is equally suitable for use in a wide variety of structures constructed to have any number of rooms and/or floors therein. As may be further seen in FIG. 1, the building B is equipped with a climate control system 10 constructed in accordance with the teachings of the present invention and installed in the interior space I of the building B. In various configurations thereof, the climate control system 10 may be an air conditioning system suitable for cooling the interior space I of the building B, a heating system suitable for warming the interior space I of the building B, a ventilating system suitable for circulating air through the interior space I of the building B, an air replenishment system for replenishing air evacuated from the interior space I of the building B, or a selected combination of cooling, warming, ventilating, and replenishing systems. Of course, it is fully contemplated that the climate control system 10 may further encompass, either alone, or in combination with one or more of the aforementioned air conditioning, heating and ventilating systems, various types of systems for treating the air in the interior space I of the building B other than those specifically identified herein.

For ease of illustration, the interior space I of the building B does not distinguish between a first, insulated, portion thereof and a second, uninsulated, portion thereof. As a result, while FIG. 1 appears to suggest that the climate control system 10 is located within the insulated portion of the interior space I of the building B, it is specifically contemplated that, as is common in the art, the climate control system 10 (as well as the various components thereof) are actually installed in the uninsulated portion of the interior space I of the building B. For example, a climate control system typically includes a central unit having inlet and outlet sides to which respective inlet and outlet junction boxes are attached. Radiating outwardly from the inlet and outlet junction boxes, respectively, are a series of inflow and outflow air ducts. For such a climate control system, the central unit, inlet junction box and outlet junction box would typically be located in the attic while the outwardly radiating inflow and outflow ducts would drop down, from the attic, through the ceiling or interior walls of the building, for termination at either inflow or outflow registers, respectively, in communication with the interior space of the building.

As may be further seen in FIG. 1, the climate control system 10 includes a central unit 12 which, as previously set forth, is envisioned as encompassing various combination of heating, cooling, ventilating and/or other types of systems for treating the air within the interior space I of the building B to be more comfortable to the occupants thereof. Untreated air removed from the interior space of the building B enters an inlet side 12*a* of the central unit 12, is selectively cooled, heated, or otherwise treated within the central unit 12 and exits the central unit 12 at an outlet side 12*b* thereof as a flow of treated air to be distributed throughout the interior space of the building B. As illustrated herein, the central unit 12 is a "vertical unit" characterized by having the inlet side 12*a* located below the central unit 12 and the outlet side 12*b* located above the central unit 12. It is fully contemplated, however, that, in an alternate embodiment thereof, the central unit 12 of the climate control system 10 may be configured as a "horizontal unit" characterized by having the inlet side located to one side of the central unit and the outlet side located to the other side of the central unit.

Coupled to the inlet and outlet sides 12*a* and 12*b,* respectively, of the central unit 12 are an inlet junction box 14 and an outlet junction box 16. As shown herein, both the inlet junction box 14 and the outlet junction box 16 are directly coupled to the inlet and outlet sides 12*a* and 12*b,* respectively, of the central unit 12. However, it is fully contemplated that, either one or both of the inlet and junction boxes 14 and 16 may, if desired, be spaced apart from the central unit 12. In such configurations, however, it would be necessary to provide an additional duct or ducts (not shown) to couple the inlet and/or outlet sides 12*a* and/or 12*b* of the central unit 12 to the inlet and/or outlet junction boxes 14 and/or 16. Of course, in the event that the inlet/outlet air duct system to be coupled to the inlet/outlet side 12*a*/12*b* of the central unit is relatively simple in design, for example, is comprised of a single air duct, it is contemplated that either one or both of the inlet/outlet junction boxes 14/16 may be omitted and the corresponding air ducts be coupled directly to the appropriate side 12*a*/12*b* of the central unit 12. Of course, in the event that the climate control system were configured without the outlet junction box 16, it is contemplated that those components which enable the climate control system 10 to perform air evacuation and ventilation operations to be more fully described below would need to be installed within the outlet air duct system or within the central unit 12 itself.

The climate control system 10 further includes at least one air inflow register 18 and at least one air outflow register 20, 21. Again, for ease of illustration, FIG. 1 representatively shows the climate control system 10 as including a single air inflow register 18 and first and second air outflow registers 20 and 21, all of which are supported by floor F of the building B. Again, it should be clearly understood, however, that the typical climate control system would include plural air inflow and air outflow registers mounted within similarly sized openings formed in the floors, walls and/or ceilings of the building B such that grills 18*a,* 20*a* and 21*a* of the inflow and outflow registers 18, 20 and 21 lay generally flush with the surface of the surrounding floor, wall or ceiling. Thus, while the inflow and outflow registers 18, 20 and 21 would be in communication with the air within the interior space I of the building B, the inflow and outflow registers 18, 20 and 21 themselves would be physically located within the uninsulated portion of the building B.

The air inflow register 18 is coupled to the inlet junction box 14 by an inflow air duct 22 while the first and second air outlet registers 20 and 21 are respectively coupled to the outlet junction box 16 by first and second outflow air ducts 24 and 25. As before, for ease of illustration, FIG. 1 shows only a single air inflow and first and second outflow air ducts 22, 24 and 25 extending through the interior space I of the building B and terminating at the inflow and outflow registers 18, 20 and 21, respectively as purely representative of the much more complex inflow and outflow air duct systems typically installed within the attic, walls and other uninsulated portions of the interior space of a building.

The climate control system 10 further includes a ventilation duct 26 coupled, on one end, to the outlet junction box 16 and, on the other end, to an opening 28 formed in a selected one of the exterior surfaces of the building B. In the embodiment illustrated in FIG. 1, the opening 28 is formed in the roof R although, in an alternate embodiment, the opening may instead be formed in a selected one of the exterior walls W. As before, while FIG. 1 appears to suggest that the ventilation duct 26 would be located in the insulated portion of the interior space I of the building B, it is specifically contemplated that the ventilation duct 26 would more typically extend through an uninsulated portion of the interior I. For example, if the central unit 12 and the outlet junction box 16 were located in the uninsulated attic portion of the building B, from the outlet junction box 16, the ventilation duct 26 would most likely extend through the uninsulated attic and terminate in the opening 28 formed in the roof R.

Finally, the climate control system 10 further includes a controller 30. While a wide variety of controllers are suitable for the uses contemplated herein, one suitable controller would be a programmable thermostat. The controller 30 includes one or more sensors for measuring one or more physical conditions within the interior space I of the building B. For example, the controller 30 may include a temperature sensor for measuring the temperature within the interior space I of the building B. Preferably, the controller 30 further includes a programable memory, processing and control circuitry, and a timer circuit (all omitted from the drawings for ease of illustration). The programmable memory maintains user selectable settings for temperature and/or other physical conditions within the interior space I of the building B while the processing and control circuitry monitors the temperature sensor (as well as any other sensors forming part of the controller 30) and the user selectable settings for the desired physical conditions within the interior space I of the building B and actuates selected components of the climate control system 10 so that the temperature or other physical conditions within the interior space I is maintained at the selected settings. Finally, and as will be more fully described below, as part of the enhanced climate control operations disclosed herein, the timer circuit is used by the processing and control circuitry to actuate selected components of the climate control system 10 for pre-selected time periods. In accordance with certain aspects of the invention, it is contemplated that, in actuating selected components of the climate control system 10, various ones of the selected components will not be actuated until a physical condition, for example, temperature, reaches a pre-selected threshold value, while others of the selected components will be variously actuated for pre-selected time periods. In contrast, in certain further aspects of the invention, it is contemplated that still other components of the climate control system 10 will remain under operator control. Finally, and as will also be more fully described below, the controller 30 is coupled to a control system 33 for the central unit 12, an exhaust fan (not visible in FIG. 1) supportably mounted within the air outlet junction box 16, a motorized damper (also not visible in FIG. 1) separating the air outlet junction box 16 from the ventilation duct 26, an in-line exhaust fan (also not visible in FIG. 1) located in the ventilation duct 26, an exhaust fan located at the end of the ventilation duct 26, and a flapper valve (also not visible in FIG. 1) located in an air replenishment duct having an inlet end which opens outside the building B and an outlet end which opens into the central unit 12.

Figure 2A:
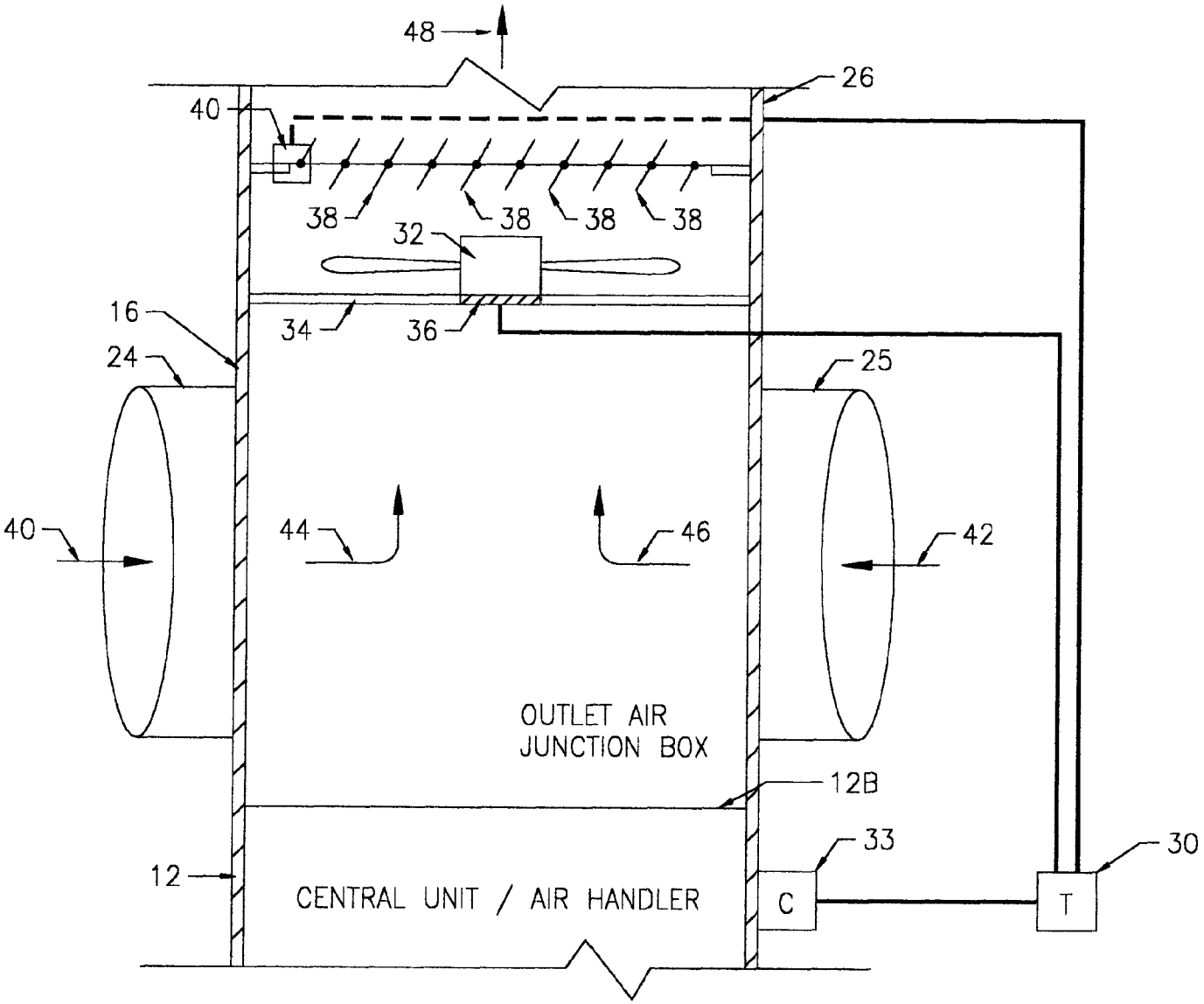
FIG. 2*a* is a cross-sectional view of the climate control system of FIG. 1 taken along lines 2—2 thereof and illustrating the flow of air, within selected portions of the climate control system of FIG. 1, during the evacuation of air from an air duct system located on an outlet side of a central unit of the climate control system.
Figure 2B:
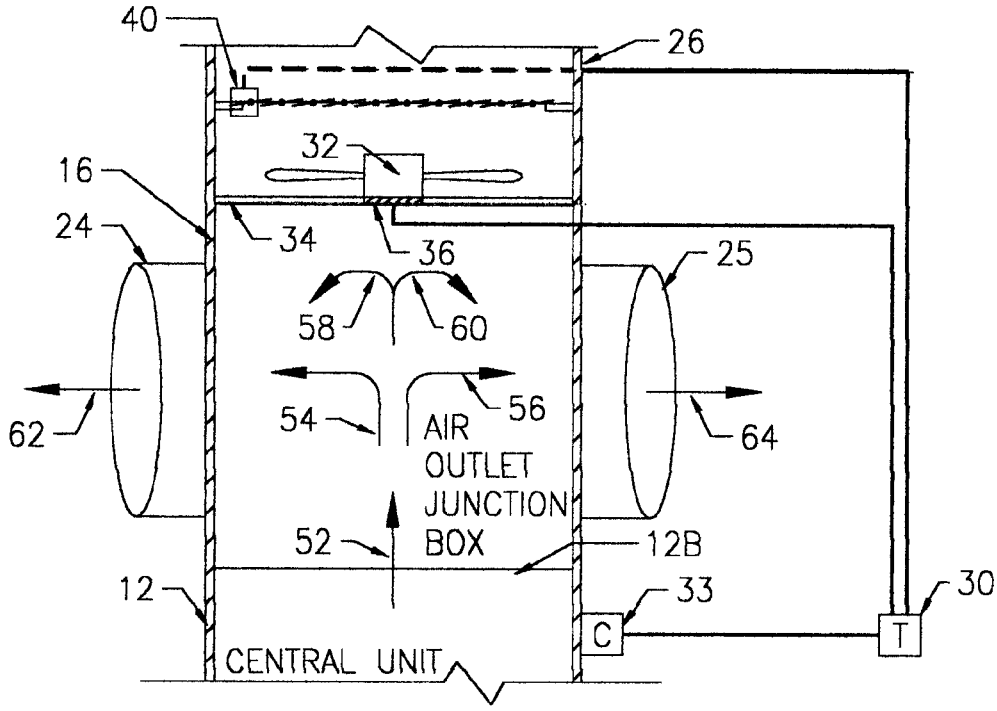
FIG. 2*b* is a second cross-sectional view of the climate control system of FIG. 1, also taken along lines 2—2 thereof but reduced in size relative to FIG. 2*a,* and illustrating the flow of air, within selected portions of the climate control system of FIG. 1, during the treatment of air withdrawn from the interior space of the building through an air duct system located on an inlet side of the central unit of the climate control system.
Figure 3A:
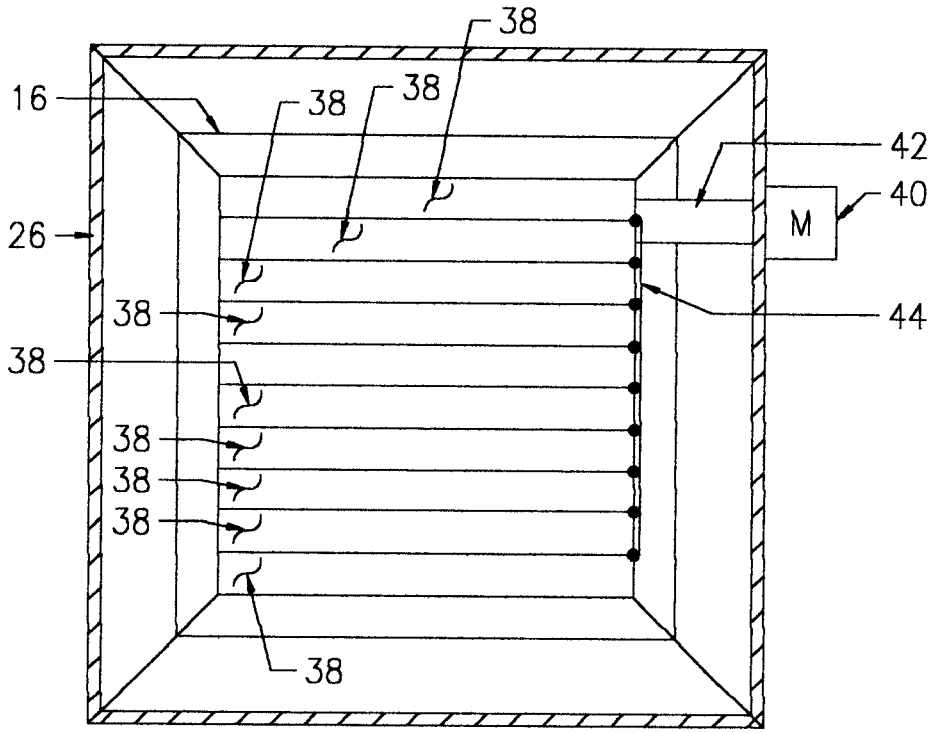
FIG. 3*a* is a first enlarged cross-sectional view taken along lines 3—3 of FIG. 1.
Figure 3B:
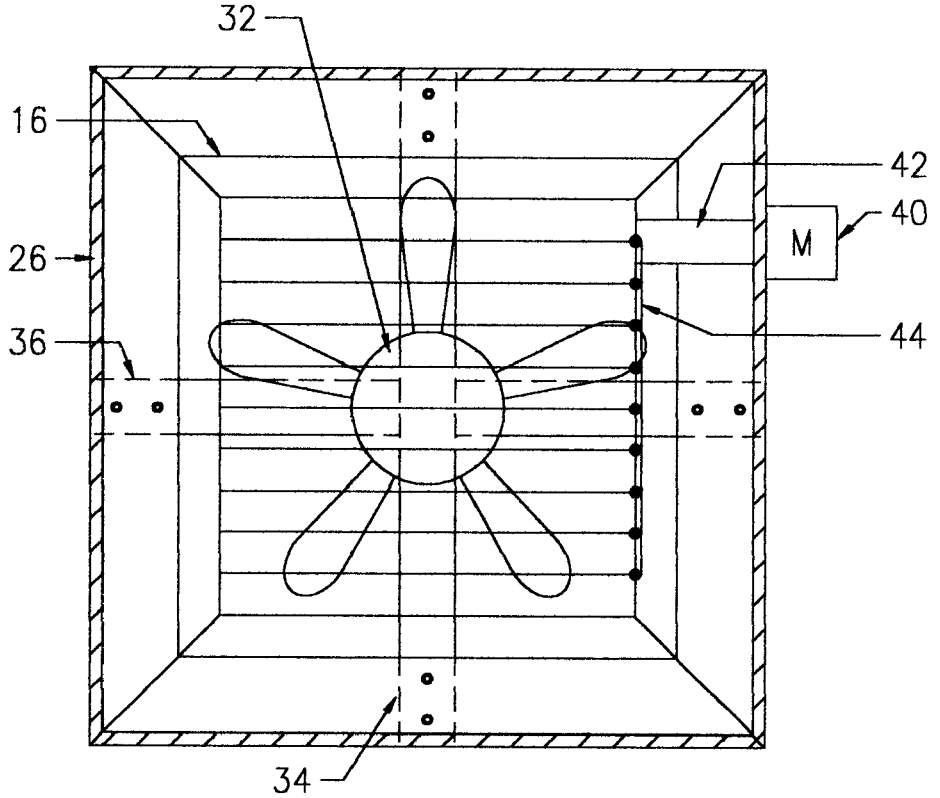
FIG. 3*b* is a second enlarged cross-sectional view taken along lines 3—3 of FIG. 1.

Referring next to FIGS. 2*a* and 3*a–b,* selected components of the climate control system 10 will now be described in greater detail. As may now be seen, in addition to its conventional usage as providing an interface between the outlet side 12*b* of the central unit 12 and the various outlet air ducts 24 and 25, and in accordance with the teachings of one aspect of the invention, the outlet junction box 16 is configured to exhaust air from the outlet air ducts 24 and 25. To perform this function, an exhaust fan 32 is supportably mounted within the outlet junction box 16. More specifically, support beams 34 and 36 are mounted across the outlet junction box 16 in a generally orthogonal configuration best shown in FIG. 3*b.* The exhaust fan 32 is then securedly mounted on the support beams 34 and 36 and electrically connected to the controller 30 such that the controller 30 can selectively actuate the exhaust fan 32.

To prevent treated air entering the outlet junction box 16 from the outlet side 12*b* of the central unit 12 from being forced into the ventilation duct 26, the outlet junction box 16 is further provided with a motorized damper system which separates the outlet junction box 16 and the ventilation duct 26. The motorized damper system is comprised of a plurality of damper blades 38 and a motor 40 coupled to each of the damper blades 38 by drive shaft 42 and linkage 44. The damper blades 38 are pivotable between a closed position shown in FIG. 3*a* in which the damper blades 38 are positioned to prevent the flow of air, from the outlet junction box 16, into the ventilation duct 26 and an open position shown in FIG. 3*b* in which the damper blades 38 are positioned to allow the flow of air between the outlet junction box 16 and the ventilation duct 26. The motor 40 is electrically connected to the controller 30 such that the controller 30 can either: (a) selectively actuate the motor 40 to rotate the drive shaft 42 and linkage 44 in a first direction to cause the damper blades 38 to pivot from the closed position to the open position; or (b) selectively actuate the motor 40 to rotate the drive shaft 42 and linkage 44 in a second direction to cause the damper blades 38 to pivot from the open position to the closed position.

Referring next to FIGS. 2*a–b* and 3*a–b,* the process by which the climate control system 10 operates to treat air located within the interior space I of the building B will now be described in greater detail. While the process is described in conjunction with a cooling operation, it should be clearly understood that the disclosed technique is equally applicable to other climate control operations such as heating operations. More specifically, prior to initiation of the treatment process, the climate control system 10 is cycled off. When the climate control system 10 is cycled off, the central unit 12, as well as any associated equipment used to cool air flowing therethrough, are powered down. Similarly, the exhaust fan 32 is powered down and the damper blades 38 are in the closed position, thus isolating the ventilation duct 26 from the air outlet junction box 16 and the air outlet ducts 24 and 25.

The controller 30 has been pre-programmed with information to be used during operation of the climate control system. More specifically, the controller 30 has been pre-programmed with a desired temperature for the interior space I of the building B. Typically, in order to minimize the number of times that the climate control system 10 will cycle on and off while maintaining the desired temperature, the controller 30 will typically have first and second threshold value, one above the desired temperature and one below the desired temperature. In a cooling operation, the controller 30 will initiate a cooling operation upon determining that the temperature of the interior space I of the building B has reached the threshold value above the desired temperature. As the interior space I of the building B cools, the controller 30 will continue the cooling operation until determining that the temperature of the interior space I has reached the threshold value below the desired temperature. Of course, the reverse would apply in heating operations. Finally, the controller 30 would be further pre-programmed with a time period selected based upon the time needed to evacuate the outlet air ducts 24 and 25 and the outlet air junction box 16. While the selected time period would vary based upon the volume of the air outlet ducts 24 and 25 and the capacity of the exhaust fan 32 to evacuate the air in the air outlet ducts 24 and 25, generally, a time period of about 1 minute will be suitable for the uses contemplated herein. Of course, it should be clearly understood that, by selecting a lengthy (or indefinite) time period for evacuating air from the air outlet ducts 24 and 25, the exhaust fan 32 would begin to draw air out of the interior space I of the building B and exhaust the withdrawn air to the outside. It should be further understood that, by operating the climate control system 10 in this manner, the climate control system 10 may be operated as a ventilating system which, depending on outside climatic conditions, would eliminate the need for initiating treatment of the air within the interior space I of the building B in the manner described herein. For such usages of the climate control system 10 as a ventilating system, the control sequence described herein should be modified to remove initiation of air treatment by the central unit 12 from the disclosed process.

Upon determining that the temperature of the interior space I has reached the threshold value above (or below) the desired temperature thereof, the controller would initiate a multi-step air treatment operation. In the first step, the controller 30 would issue a first signal to the motor 40 linked to the damper blades 38 and a first signal to the exhaust fan 32. The signal transmitted to the motor 40 would cause the shaft 42 thereof to rotate in a direction such that the linkage 44 causes the damper blades 38 to move from the closed position illustrated in FIG. 3*a* to the open position illustrated in FIG. 3*b*. Conversely, the signal transmitted to the exhaust fan 32 would cause the exhaust fan 32 to rotate in a direction which would cause air in the outlet junction box 16 to be drawn into the ventilation duct 26.

By moving the damper blades 38 into the open position and rotating the exhaust fan 32 in the described manner, stagnant air resting in the outlet air ducts 24 and 25 which has, over time, absorbed heat and is likely hotter than the air in the interior space I of the building B is evacuated from the outlet air ducts 24 and 25. More specifically, the rotation of the exhaust fan 32 would draw air out of outlet air ducts 24 and 25 and along paths 40 and 42, respectively, and into the outlet air junction box 16. From the outlet air junction box 16, continued rotation of the evacuation fan 36 would draw the air along paths 44 and 46 and past the exhaust fan 32. Once past the exhaust fan 32, continued rotation of the exhaust fan 32 would push the air out of the air outlet junction box 16, past the damper blades 38, into the ventilation duct 26 and through the ventilation duct 26 along path 48.

Upon expiration of the pre-selected time period, the controller determines that the outlet air ducts have been evacuated and that an air treatment operation, in the foregoing example, a cooling operation, may be commenced without the undesired forcing of hot, stagnant air sitting in the outlet air ducts 24 and 25 into the interior I of the building B. Accordingly, upon expiration of the pre-selected time period, the controller issues a second control signal to the motor 40 which causes the motor 40 to rotate the shaft 42 in a second direction such that the linkage 44 causes the damper blades 38 to move from the open position illustrated in FIG. 3*b* to the closed position illustrated in FIG. 3*a*. The controller 30 also issues a second control signal to the exhaust fan 32 which causes the exhaust fan 32 to stop rotating. Finally, the controller 30 issues a first control signal to the control system 33 for the central unit 12. In response thereto, the control system 33 powers up the central unit 12 to commence air treatment operations. Once powered up, the central unit 12 draws untreated air from the interior space I of the building B along path 50 (see FIG. 1) and into the inlet air duct system 22. From the inlet air duct system 22, the untreated air is drawn into the central unit 12 where the untreated air is treated, for example, by cooling the air. A blower unit (not visible in FIGS. 2*a–b*) forming part of the central unit 12 then forces the treated air into the air outlet junction box 16 along path 52 (see FIG. 2*b*). As the damper blades 38 separating the outlet junction box 16 from the ventilation duct 26 are closed, the treated air forced into the air outlet junction box 16 is then forced into the air outlet ducts 24 and 25 along paths 54, 56, 58 and 60, through the air outlet ducts 24 and 25 along paths 62 and 64 and into the interior space I of the building B along paths 66 and 68. As increasing amounts of cooled air are forced into the interior space I of the building B, the temperature of the interior space I begins to drop. When the controller 30 detects that the temperature of the interior space I has dropped to the threshold value below the desired temperature, the controller 30 issues a second control signal to the control system 33 which causes the control system 33 to power down the central unit 12.

Figure 2C:
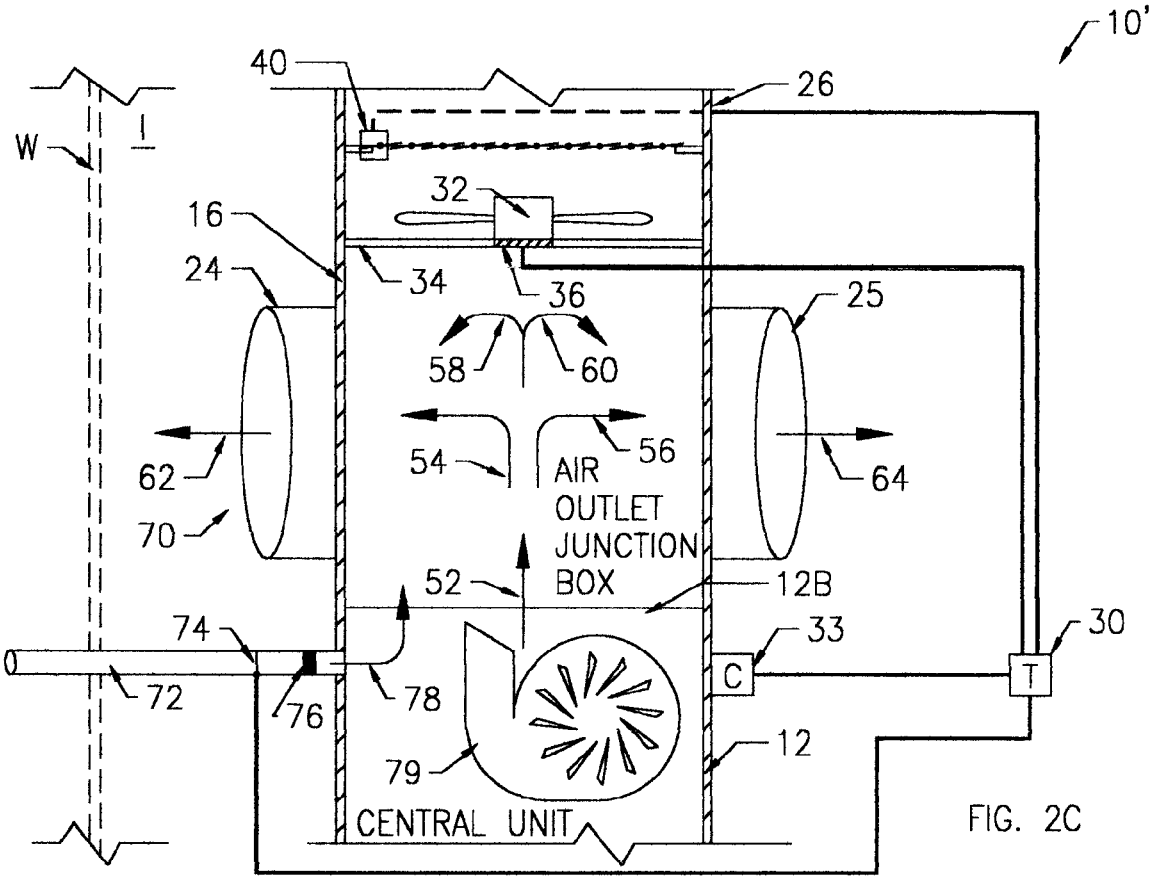
FIG. 2*c* is a cross-sectional view of an alternate embodiment of the climate control system of FIG. 1 which incorporates an air replenishment system therein.

Referring next to FIG. 2*c*, an alternate embodiment of the climate control system 10, hereafter referred to as climate control system 10', will now be described in greater detail. The climate control system 10' differs from the climate control system 10 previously described in that the climate control system 10' further includes an air replenishment system 70 which compensates for air evacuated from the outlet air ducts 24 and 25 by the previously described air evacuation system. By replenishing air removed from the outlet air ducts 24 and 25 and exhausted from the building B, it is contemplated that the air replenishment system 70 will compensate for pressure differentials resulting between the interior and exterior of the building B from periodic reductions in the amount of air found within the interior space I of the building B. Also, in FIG. 2*c*, the central unit 12 is now shown such that blower unit 79 which forces treated air into the air outlet junction box 16 along path 52 is representatively illustrated.

The air replenishment system 70 is comprised of an air replenishment duct 72 having an inlet end which opens outside the building B and an outlet end which opens into the central unit 12 at a location generally forward of the flow of treated air being produced by the blower 79. The air replenishment system 70 further includes a flapper valve 74 located, along the interior of said air replenishment duct 72, intermediate to said inlet and outlet ends thereof. The flapper valve 74 is movable between a closed position shown in FIG. 2*c* in which the flapper valve 74 blocks outside air from entering the air outlet junction box 16 and an open position (not shown) which permits outside air to be drawn through the air replenishment duct and into the central unit 12. Also located along the air replenishment duct 72 is a filter 76 which prevents dust and other particulate matter from entering the interior space I of the building B through the air replenishment duct 72.

As may be further seen in FIG. 2*c,* the controller 30 is coupled to the flapper valve 74. As will be more fully described below, the controller 30 will periodically issue a control signal to the flapper valve 74 which causes the flapper valve 74 to move from its normally closed position shown in FIG. 2*c* into the open position. Once open, air forced out of the central unit 12 along path 52 will draw outside air through the air replenishment duct 72, the central unit 12 and into the air outlet junction box 16, along path 78, where it is forced, together with the treated air flowing along path 54, into the outlet air duct 24, thereby providing, along path 62, both treated air and replenishing air to the interior space I of the building B. At a selected time period after initiating the air replenishment cycle, the controller 30 will issue a second control signal to the flapper valve 74 to cause the flapper valve 74 to return back to the closed position illustrated in FIG. 2*c*. While it is contemplated that the replenishment cycle may be of any duration, it is contemplated that its duration can typically be shorter than the duration of an air treatment cycle. Further, while it is further contemplated that the air replenishment cycle may operate independently of (or partially or fully concurrently with) the air treatment cycle, it is acknowledged that both the air replenishment and air treatment cycles require the operation of the blower 79 of the central unit 12. Accordingly, by timing the air replenishment cycle to coincide with a portion of an air treatment cycle, there will be no need to independently power-up the blower 79 for both air treatment and air replenishment cycles. Finally, for those embodiments of the invention in which the climate control system, for example, the climate control system 10', include an air replenishment system, it is contemplated that the controller 30, which is normally configured to actuate heating, cooling and/or ventilation cycles independently based upon either preselected timing cycles, preselected physical conditions, for example, temperature, or a combination thereof, be instead configured to actuate heating, cooling, ventilation and/or air replenishment cycles based upon either preselected timing cycles, preselected physical conditions, user commands, or a combination thereof.

Figure 4:
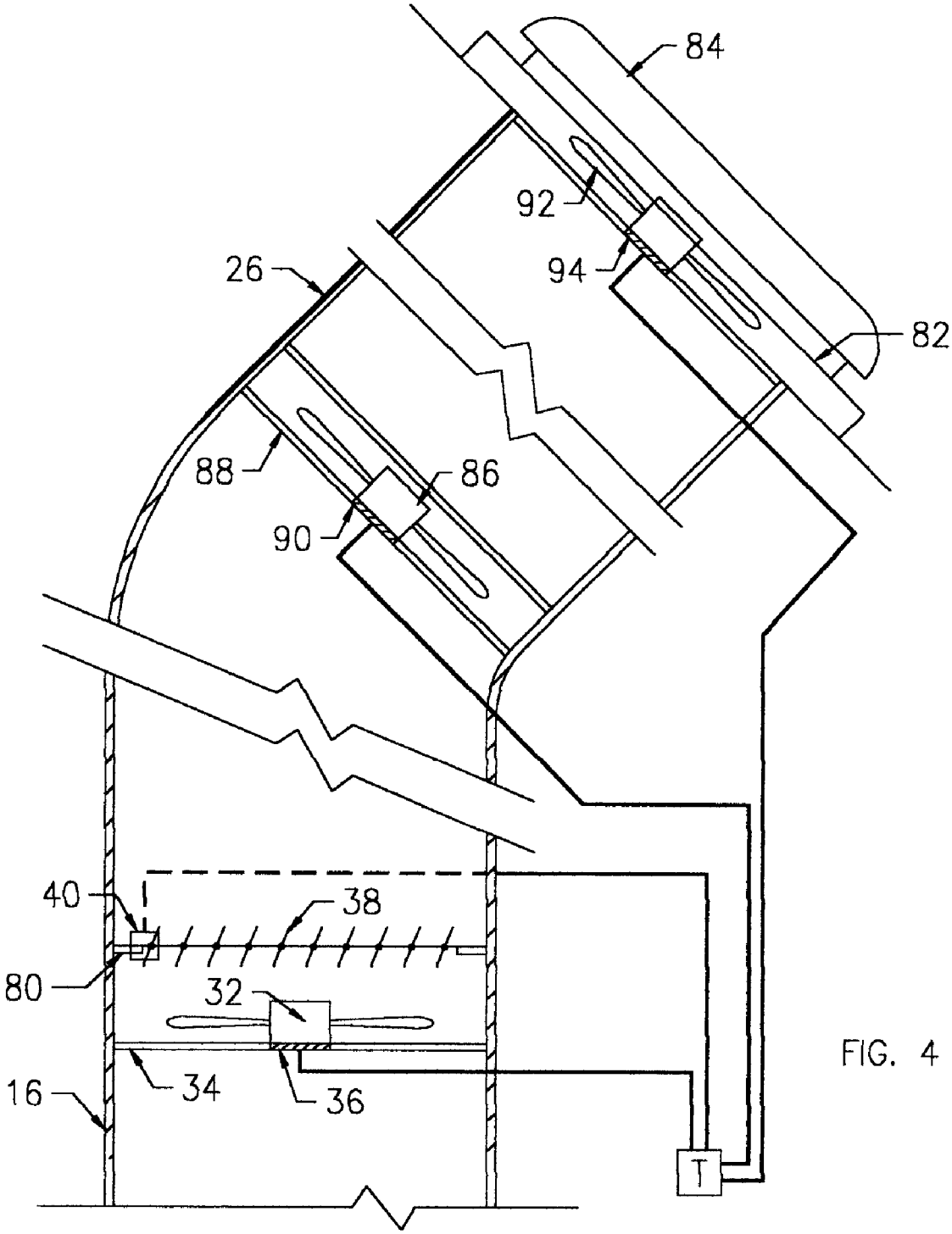
FIG. 4 is an enlarged partially fragmented cross-sectional view taken along lines 4—4 of FIG. 1.

Referring next to FIG. 4, the ventilation duct 26 will now be described in greater detail. As previously discussed, the ventilation duct 26 has an inlet end 80 in communication with the air outlet junction box 16 and an outlet end 82 which opens to the outside. Preferably, the outlet end 82 is covered by a hood 84 which protects the ventilation duct 26 from the elements. As further previously discussed, when the damper blades 38 are pivoted into the open position and the exhaust fan 32 rotated, stagnant air is evacuated from the outlet air ducts 24 and 25, through the air duct junction box 16 and into the ventilation duct 26 where it is exhausted to the outside. It is contemplated that the continued rotation of the exhaust fan 32 will most likely force the air previously exhausted into the ventilation duct 26 to be forced through the ventilation duct 26 and through the outlet end 82.

To enhance the evacuation of the air previously contained in the air ducts 24 and 25 to the outside, it is contemplated that the ventilation duct 26 may be provided with any number of booster exhaust fans 86, 88 to assist the exhaust fan 32 in forcing the evacuated air through the entire length of the ventilation duct 26 and to the outside. The booster exhaust fan 86 is an in-line booster fan supportably mounted at a location intermediate the inlet and outlet ends 80 and 82 of said ventilation duct 26 by support beams 88 and 90 which are mounted across the ventilation duct 26 in a generally orthogonal configuration. In a similar fashion, the booster exhaust fan 88 is an outlet booster fan supportably mounted at the outlet end 82 of the ventilation duct 26 by support beams 92 and 94 which are mounted across the ventilation duct 26 in a generally orthogonal configuration. Alternately, one or more of the booster fans 86 and 88 may instead be supportably mounted within one or more of the air outlet ducts 24 or 25.

Each of the booster fans 86 and 88 are coupled to the controller 30 and are actuated in conjunction with the exhaust fan 32. Thus, when the controller 30 issues a control signal to the exhaust fan 32 to begin rotation, the controller 30 similarly issues a control signal to the booster fans 86 and 88 to begin rotation as well.

Although an illustrative embodiment of the invention has been shown and described, other modifications, changes, and substitutions are intended in the foregoing disclosure. Accordingly, it is appropriate that the appended claims be construed broadly and in a manner consistent with the scope of the invention.

What is claimed is:

1. A climate control system for treating air within an interior space of a building, said climate control system comprising:

a central unit having inlet and outlet sides;

a first, inflow, air duct system coupled to said inlet side of said central unit;

a second, outflow, air duct system coupled to said outlet side of said central unit;

said central unit treating air withdrawn from said interior space of said building through said first air duct system and returning said treated air to said interior space of said building through said second air duct system; and an air evacuation system for withdrawing air from said second air duct system prior to said central unit treating air withdrawn from said interior space of said building and returning said treated air to said interior space of said building through said second air duct system;

wherein the climate control system is configured to evacuate said second air duct system using said air evacuation system before initiating treatment of air withdrawn from said interior space of said building through said first air duct system.

2. The climate control system of claim 1 and further comprising:

a controller, coupled to said air evacuation system and said central unit, for actuating said evacuation of air from said second air duct system and said treatment of said air withdrawn from said interior space of said building through said first air duct system, respectively.

3. The climate control system of claim 2, wherein said controller initiates actuation of said air evacuation system and said central unit by executing an actuation sequence.

4. The climate control system of claim 3, wherein:

said actuation sequence is comprised of first and second steps;

in said first step, said controller actuates said air evacuation system for a pre-selected period of time; and in said second step, said controller actuates said central unit until a measurable physical condition meets a pre-selected threshold value.

5. The climate control system of claim 4, wherein:

said controller deactuates said air evacuation system before actuating said central unit; and said pre-selected period of time for actuating said air evacuation system is selected based upon the time required for said air evacuation system to remove all untreated air from said second air duct system.

6. The climate control system of claim 5, wherein:

said measurable physical condition is temperature; and said controller further comprises a sensor for determining temperature of said interior space of said building.

7. The climate control system of claim 6, wherein said central unit is configured to selectively heat, cool or ventilate said interior space of said building.

8. The climate control system of claim 7, wherein:

said central unit treats air within said interior space of said building by warming said air withdrawn from said interior space of said building through said first air duct system and then returning said warmed air to said interior space of said building through said second air duct system; and said controller executes said actuation sequence upon determining that the temperature of said interior space of said building has dropped below a pre-selected threshold value.

9. The climate control system of claim 7, wherein:

said central unit treats air within said interior space of said building by cooling said air withdrawn from said interior space of said building through said first air duct system and then returning said cooled air to said interior space of said building through said second air duct system; and said controller executing said actuation sequence upon determining that the temperature of said interior space of said building has risen above a pre-selected threshold value.

10. The climate control system of claim 7, wherein:

said central unit treats air within said interior space of said building by withdrawing air from said interior space of said building through said first air duct system and then returning said withdrawn air to said interior space of said building through said second air duct system;

said controller executing said actuation sequence upon receipt of a user-generated command.

11. A climate control system for treating air within an interior space of a building, said climate control system comprising:

a central unit having inlet and outlet sides;

a first, inflow, air duct system coupled to said inlet side of said central unit;

a second, outflow, air duct system coupled to said outlet side of said central unit;

said central unit treating air withdrawn from said interior space of said building through said first air duct system and returning said treated air to said interior space of said building through said second air duct system; and an air evacuation system for withdrawing air from said second air duct system prior to said central unit treating air withdrawn from said interior space of said building and returning said treated air to said interior space of said building through said second air duct system;

said air evacuation system further comprises:

a ventilation duct having first and second ends, said first end of said ventilation duct in communication with said second air duct system and said second end of said ventilation duct having an opening located outside said building; and a exhaust fan for drawing air out of said second air duct system and into said ventilation duct;

said exhaust fan operable to draw air out of said second air duct only when said central unit is not returning treated air to said interior space of said building through said second air duct system.

12. The climate control system of claim 11, wherein said air evacuation system further comprises:

a damper attached to said first end of said ventilation duct; said damper pivotable between a first, closed, position in which said damper prevents air from flowing into said ventilation duct and a second, open, position in which said second air duct system is in communication with said ventilation duct.

13. The climate control system of claim 12 and further comprising:

a controller, said controller coupled to said exhaust fan and said damper for actuating said evacuation of said second air duct system, said controller further coupled to said central unit for actuating said treatment of said air withdrawn from said interior space of said building through said first air duct system.

14. The climate control system of claim 13, wherein said controller initiates actuation of said air evacuation system and said central unit by executing an actuation sequence.

15. The climate control system of claim 14, wherein:

said actuation sequence is comprised of first and second steps, said second step executed a pre-selected period of time after said first step is executed;

in said first step, said controller issues first control signals to said damper and said exhaust fan, respectively, said first control signal to said damper causing said damper to move from said closed position to said open position and said first control signal to said exhaust fan causing said exhaust fan to begin rotating such that air is drawn out of said second air duct system and into said ventilation duct; and in said second step, said controller issues second control signals to said damper and said exhaust fan, respectively, and a first control signal to said central unit, said second control signal to said damper causing said damper to move from said open position to said closed position, said second control signal to said exhaust fan causing said exhaust fan to stop rotating, and said first control signal to said central unit causing said central unit to begin treating air withdrawn from said interior space of said building through said first air duct system.

16. The climate control system of claim 15, wherein:

said pre-selected period of time is selected based upon the time required for said air evacuation system to remove all untreated air from said second air duct system.

17. The climate control system of claim 16, wherein:

said actuation sequence further comprises a third step in which said controller issues a second control signal to said central unit when a measurable physical condition meets a pre-selected threshold value, said second control signal to said central unit causing said central unit to stop treating air withdrawn from said interior space of said building through said first air duct system.

18. The climate control system of claim 15, wherein:

said measurable physical condition is temperature; and said controller further comprises a sensor for determining temperature of said interior space of said building.

19. A climate control system for treating air within an interior space of a building, said climate control system comprising:

a central unit having inlet and outlet sides;

a first, inflow, air duct system having an outlet side coupled to said inlet side of said central unit;

a second, outflow, air duct system having an inlet side coupled to said outlet side of said central unit;

said central unit treating air withdrawn from said interior space of said building through said first air duct system and returning said treated air to said interior space of said building through said second air duct system;

an air evacuation and exhaustion system for withdrawing air from said second air duct system and exhausting said withdrawn air from said building, said air evacuation and exhaustion system withdrawing and exhausting air from said second air duct system prior to said central unit treating air withdrawn from said interior space of said building and returning said treated air to said interior space of said building through said second air duct system.

20. The climate control system of claim 19 and further comprising an air replenishment system for replenishing air exhausted from said second air duct system.

21. The climate control system of claim 20, wherein:

said air replenishment system further comprises an air replenishment duct having first and second ends, said first end of said air replenishment duct having an opening located outside said building and said second end of said air replenishment duct in communication with said central unit.

22. The climate control system of claim 20 and further comprising:

an air outlet junction box coupled between said outlet side of said central unit and said inlet side of said second air duct system;

wherein treated air pumped out of said central unit is returned to said interior space of said building through said air outlet junction box and said second air duct system.

23. The climate control system of claim 22, wherein said air evacuation and exhaustion system further comprises:

a ventilation duct having first and second ends, said first end of said ventilation duct in communication with said air outlet junction box and said second end of said ventilation duct having an opening located outside said building; and a exhaust fan for drawing air out of said second air duct system and into said ventilation duct;

wherein said exhaust fan is operable to draw air out of said second air duct only when said central unit is not returning treated air to said interior space of said building through said air outlet junction box and said second air duct system.

24. The climate control system of claim 23, wherein said exhaust fan is supportably mounted within said air outlet junction box.

25. The climate control system of claim 24, wherein said air evacuation and exhaustion system further comprises:

a damper for selectively blocking access to said first end of said ventilation duct, said damper pivotable between a first, closed, position in which said damper prevents air from flowing into said ventilation duct and a second, open, position in which air may flow through said damper and into said ventilation duct;

said damper being supportably mounted within said air outlet junction box.

26. The climate control system of claim 25, wherein said air evacuation and exhaustion system further comprises a booster fan for assisting said exhaust fan in forcing air, drawn out of said second air duct, out said opening located outside said building.

27. The climate control system of claim 26, wherein said booster fan is supportably mounted at said second end of said ventilation duct.

28. The climate control system of claim 26, wherein said booster fan is supportably mounted, within said ventilation duct, at a location intermediate said first and second ends thereof.

29. The climate control system of claim 26, wherein said booster fan is supportably mounted within said second air duct system.

30. The climate control system of claim 23, wherein:

said air replenishment system further comprises an air replenishment duct having first and second ends, said first end of said air replenishment duct having an opening located outside said building and said second end of said air replenishment duct in communication with said central unit.

31. The climate control system of claim 30 and further comprising:

a flapper valve supportably mounted, within said air replenishment duct, at a location intermediate said first and second ends thereof, said flapper valve movable between a first position in which said flapper valve prevents outside air from being drawn into said central unit through said air replenishment duct and a second position in which said flapper valve allows outside air to be drawn into said central unit through said air replenishment duct.

32. The climate control system of claim 31 and further comprising:

a controller, said controller coupled to said exhaust fan and said damper for actuating said evacuation of said second air duct system, said controller further coupled to said central unit and said flapper valve for actuating said treatment of said air withdrawn from said interior space of said building through said first air duct system and for actuating replenishment of said air evacuated from said second air duct system.

33. The climate control system of claim 32, wherein said controller initiates actuation of said air evacuation and exhaustion system, said central unit and said air replenishment system by executing an actuation sequence.

34. The climate control system of claim 33, wherein:

said actuation sequence is comprised of first and second steps, said second step executed a pre-selected time period after said first step is executed;

in said first step, said controller issues first control signals to said damper and said exhaust fan, respectively, said first control signal to said damper causing said damper to move from said closed position to said open position and said first control signal to said exhaust fan causing said exhaust fan to begin rotating such that air is drawn out of said second air duct system and into said ventilation duct; and in said second step, said controller issues second control signals to said damper and said exhaust fan, respectively, and first control signals to said central unit and said flapper valve, respectively, said second control signal to said damper causing said damper to move from said open position to said closed position, said second control signal to said exhaust fan causing said exhaust fan to stop rotating, said first control signal to said central unit causing said central unit to begin treating air withdrawn from said interior space of said building through said first air duct system and said first control signal to said flapper valve causing said flapper valve to move from said closed position to said open position;

said central unit generating a flow of treated air through said air outlet junction box and said second air duct system which draws outside air, through said air replenishment duct, and into said air outlet junction box.

35. The climate control system of claim 34, wherein:

said pre-selected period of time is selected based upon the time required for said air evacuation system to remove all untreated air from said second air duct system.

36. The climate control system of claim 35, wherein:

said actuation sequence further comprises a third step in which said controller issues a second control signal to said flapper valve, said second control signal to said flapper valve causing said flapper valve to move from said open position to said closed position.

37. The climate control system of claim 36, wherein:

said actuation sequence further comprises a fourth step in which said controller issues a second control signal to said central unit when a measurable physical condition meets a pre-selected threshold value, said second control signal to said central unit causing said central unit to stop treating air withdrawn from said interior space of said building through said first air duct system.

38. The climate control system of claim 37, wherein:

said measurable physical condition is temperature; and said controller further comprises a sensor for determining temperature of said interior space of said building.

* * * * *

UNITED STATES PATENT AND TRADEMARK OFFICE

CERTIFICATE OF CORRECTION

PATENT NO. : 6,439,466 B2
DATED : August 27, 2002
INVENTOR(S) : Fikes, Jody D.

It is certified that error appears in the above-identified patent and that said Letters Patent is hereby corrected as shown below:

Column 3,
Line 17, replace “modem” with -- modern --.

Column 6,
Line 54, replace “fourth,” with -- fourth --.

Column 8,
Line 51, replace “system were” with -- system 10 were --.

Signed and Sealed this

Seventeenth Day of June, 2003

JAMES E. ROGAN
*Director of the United States Patent and Trademark Office*